US007806153B2

(12) United States Patent
Reimler

(10) Patent No.: US 7,806,153 B2
(45) Date of Patent: Oct. 5, 2010

(54) LOG DEBARKING BLADE

(76) Inventor: James L. Reimler, 7125 Fairhill Pl., Charlotte, NC (US) 28270

( * ) Notice: Subject to any disclaimer, the term of this patent is extended or adjusted under 35 U.S.C. 154(b) by 120 days.

(21) Appl. No.: 12/014,572

(22) Filed: Jan. 15, 2008

(65) Prior Publication Data

US 2009/0178730 A1 Jul. 16, 2009

(51) Int. Cl.
*B27L 1/00* (2006.01)

(52) U.S. Cl. ..... 144/208.4

(58) Field of Classification Search ..... 144/208.1, 144/208.4, 208.5, 208.8, 208.9, 208.91, 24.13, 144/241

See application file for complete search history.

(56) References Cited

U.S. PATENT DOCUMENTS

| | | | | |
|---|---|---|---|---|
| 2,788,034 | A | 4/1957 | Brundell et al. | |
| 2,880,771 | A | 4/1959 | Annis, Jr. | |
| 3,190,327 | A | 6/1965 | Robbins | |
| 3,221,785 | A | 12/1965 | Valo | |
| 3,653,417 | A | 4/1972 | Cervenak | |
| 3,704,733 | A | 12/1972 | McColl | |
| 3,709,272 | A | 1/1973 | Bowers | |
| 3,973,607 | A | 8/1976 | Jonsson | |
| 3,991,800 | A | 11/1976 | Palmquist | |
| 4,280,541 | A | 7/1981 | Reimler et al. | |
| 4,425,951 | A * | 1/1984 | Pousette et al. | 144/208.8 |
| 4,566,371 | A | 1/1986 | Jorgensen et al. | |
| 4,653,559 | A | 3/1987 | Ackerman | |
| 4,657,056 | A | 4/1987 | Hutson | |
| 4,844,201 | A | 7/1989 | Ackerman | |
| 4,865,095 | A | 9/1989 | Magnusson | |
| 5,201,353 | A | 4/1993 | Weill | |
| 5,460,212 | A | 10/1995 | Darden | |
| 5,472,027 | A | 12/1995 | Ackerman | |
| 6,675,846 | B1 | 1/2004 | Hoffman | |
| 6,834,692 | B2 | 12/2004 | Lindsay et al. | |
| 7,350,548 | B1 | 4/2008 | Cholewczynski et al. | |

* cited by examiner

*Primary Examiner*—Shelley Self
(74) *Attorney, Agent, or Firm*—Adams Intellectual Property Law

(57) ABSTRACT

A debarking blade includes an elongate blade body having an attachment end, an opposed free end, and an arcuate concave inner edge surface extending between the opposing ends and adapted to face generally inwardly toward the rotational axis of the ring rotor. A detachable cutting tip having a cutting edge thereon is releasably mounted on the free end of the blade body for engaging and debarking a log. A detachable climbing edge insert is releasably mounted on the blade body between the attachment end and the free end. The climbing edge portion engages successive logs being fed into the debarker for deflecting the debarking blade out of the path of the logs.

7 Claims, 4 Drawing Sheets

LOG DEBARKING BLADE

TECHNICAL FIELD AND BACKGROUND OF THE INVENTION

This invention relates to debarking machines generally referred to as "mechanical ring" debarkers. Debarkers of this type have a ring rotor into and through which successive logs are fed to be engaged and stripped of bark. More particularly, the invention relates to an improved tool, referred to in this application as a "blade" or "debarking blade", for mechanical ring debarking machines and an improved log debarker that incorporates a novel debarking blade.

In debarking machines of the ring rotor type, several debarking blades are circularly arranged around the central opening of the rotor and extend generally radially inwardly with their cutting edges positioned adjacent the axis of the rotor. As they are rotated by the ring rotor, the blades follow the periphery of the logs while the cutting tips scrape against and remove the bark at the cambium layer. When the rotor is rotated and a log is being fed into the rotor inlet, the end of the log engages the debarking blades and causes them to rotate outwardly so that the each of the climbing edges of the respective blades climbs upwardly onto the peripheral surfaces of the log.

Conventional debarking machines have blades with an "opening edge" or "climbing edge" for the purpose of engaging the end of the log, as described above. Thus, while the climbing edge of the blade guides the blade into the proper position to debark the log, the cutting tip of the blade performs the removal of the the bark as it moves through the debarker. Blades with climbing edges are disclosed in U.S. Pat. No. 2,880,771 (Annis, Jr.); U.S. Pat. No. 3,709,272 (Bowers); U.S. Pat. No. 3,973,607 (Jonsson); and applicant's U.S. Pat. No. 4,280,541.

While such blades are provided with a removable and replaceable cutting tip on the end of the blade, the climbing edges are generally formed of built-up material welded onto the side of the blade and sharpened for use. When worn, the blades are removed from the debarker and either disposed of or returned to a rebuild facility where the climbing edge is removed, new material welded to the side of the blade, and then sharpened. The rebuilt blade is then returned to the user for re-installation on the debarker.

These blades and the manner of rebuilding them is inefficient and wastes time, money and materials. Moreover, because of the angle required for the climbing edge, many such blades are cast in a complex shape necessary to permit the climbing edge to be built up on the blade at the proper angle and with sufficient material to last a relatively long time before repair becomes necessary.

SUMMARY OF THE INVENTION

Therefore, it is an object of the invention to provide a debarking blade for a ring-type debarker that has both a field-replaceable cutting tip and a field-replaceable climbing edge.

These and other objects and advantages of the invention are achieved by providing a debarking blade for a debarking machine of the type having a rotatable ring rotor through which logs are longitudinally fed during a debarking operation, and comprising an elongate blade body having an attachment end, an opposed free end, and an arcuate concave inner edge surface extending between the opposing ends and adapted to face generally inwardly toward the rotational axis of the ring rotor. A detachable cutting tip having a cutting edge thereon is releasably mounted on the free end of the blade body for engaging and debarking a log. A detachable climbing edge insert is releasably mounted on the blade body between the attachment end and the free end. The climbing edge portion has a sharp edge defining a log-engaging, climbing edge for engagement by successive logs being fed into the debarker. The climbing edge deflects the debarking blade out of the path of the logs during rotation of the ring rotor to protect the blade from direct impact by the leading end of the log and to properly position the cutting tip for debarking the log.

According to one embodiment of the invention, the blade body comprises steel plate having opposed, planar, parallel sides.

According to another embodiment of the invention, the detachable climbing edge insert is mounted on the blade body by a plurality of bolts positioned through respective aligned holes in the climbing edge insert and the blade body.

According to yet another embodiment of the invention, the climbing edge insert is mounted on the inner edge surface between the parallel sides of the blade body.

According to yet another embodiment of the invention, the climbing edge insert and the cutting tip are mounted on the blade body in closely spaced-apart relation to each other.

According to yet another embodiment of the invention, the blade body is formed of cast steel and includes an arcuate, longitudinally-extending side edge.

According to yet another embodiment of the invention, the climbing edge insert has a curvature corresponding to the curvature of the arcuate shape of the blade body at the point of attachment of the climbing edge insert to the blade body.

According to yet another embodiment of the invention, the blade includes an enlarged cutting head fixed to the blade body with a major widthwise dimension perpendicular to the opposed, planar, parallel sides of the blade body. The cutting tip is detachably mounted to the cutting head and projects outwardly from the major widthwise dimension of the cutting head.

According to yet another embodiment of the invention, a debarking blade for a debarking machine of the type is provided, and has a rotatable ring rotor through which logs are longitudinally fed during a debarking operation. The blade includes an elongate arcuate body having opposing ends and an arcuate concave inner surface extending therebetween and adapted to face generally inwardly toward the rotational axis of the ring rotor. A detachable cutting tip has a cutting edge thereon releasably mounted on the free end of the blade body for engaging and debarking a log. A detachable climbing edge insert is releasably mounted on the blade body between the attachment end and the free end. The climbing edge portion has a sharp edge defining a log engaging climbing edge for engagement by successive logs being fed into the ring rotor and deflects the debarking blade out of the path of the logs during rotation of the ring rotor to protect the blade from direct impact by the leading end of the log and to properly position the cutting tip for debarking the log. The climbing edge insert projects rearwardly from the blade body and has one end that terminates closely adjacent to the cutting tip. The insert defines a terminal corner portion that projects rearwardly of the cutting tip for protectively shielding the cutting tip from impact by the leading ends of successive logs being fed through the ring rotor and for preventing the leading ends of the logs from engaging the cutting tip.

According to yet another embodiment of the invention, a mechanical ring debarker is provided for removing bark from logs as they are passed through the debarker from an upstream to a downstream end, and comprises an infeed conveyor assembly for passing successive logs downstream into a ring assembly, and an outfeed conveyor assembly for removing the logs from the ring assembly and conveying them downstream. The ring assembly includes a ring rotor to which a plurality of debarking blades are mounted for engagement by successive logs being fed into the ring assembly for deflecting the debarking blade out of the path of the logs during rotation of the ring rotor. Each of the plurality of debarking blades comprises an elongate blade body having an attachment end, an opposed free end, and an arcuate concave inner edge surface extending between the opposing ends and adapted to face generally inwardly toward the rotational axis of the ring rotor. A detachable cutting tip is provided and has a cutting edge thereon releasably mounted on the free end of the blade body for engaging and debarking a log. A detachable climbing edge insert is releasably mounted on the blade body between the attachment end and the free end, and the climbing edge portion has a substantially sharp edge defining a log engaging climbing edge for engagement by successive logs being fed forwardly for deflecting the debarking blade out of the path of the logs during rotation of the ring rotor to protect the blade from direct impact by the leading end of the log and to properly position the cutting tip for debarking the log.

BRIEF DESCRIPTION OF THE DRAWINGS

Some of the objects of the invention have been set forth above. Other objects and advantages of the invention will appear as the description of the invention proceeds when taken in conjunction with the following drawings, in which.

DESCRIPTION OF THE PREFERRED EMBODIMENTS AND BEST MODE

Figure 1:
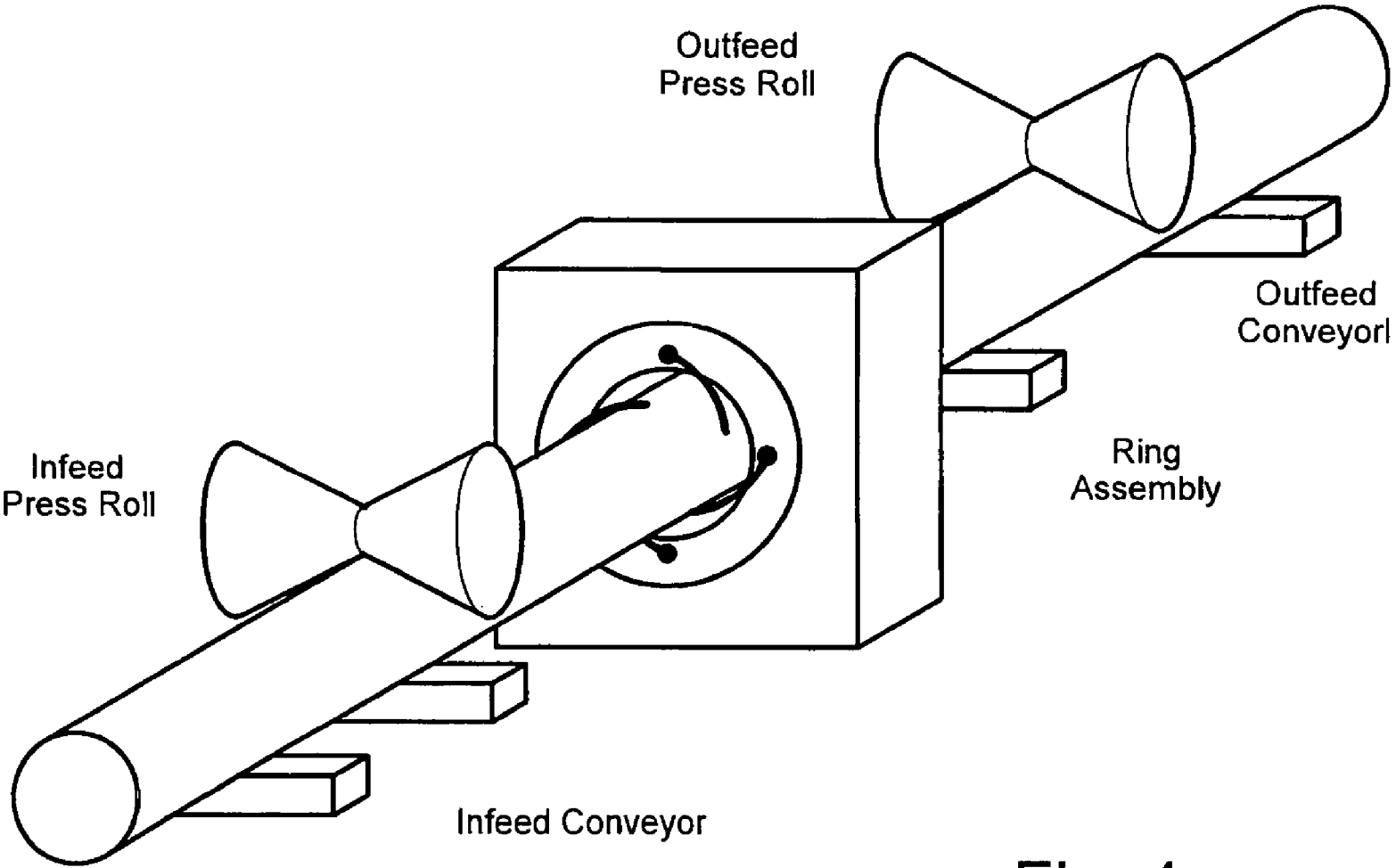
FIG. 1 is a schematic view of one type of mechanical ring debarker.

Referring now specifically to the drawings, a mechanical ring debarker is shown generally in FIG. 1, with its major operating elements carrying appropriate descriptive labels. The debarker shown in FIG. 1 is generally illustrative of mechanical ring debarkers, and is intended only to provide one example of the basic operating principles of this type of debarker. The particular debarker shown in FIG. 1 includes an infeed conveyor and an infeed press roll that feeds logs into a ring assembly that includes a ring rotor carrying a plurality of curved debarker blades of the type described in detail below. Bark is cut in a scraping motion from the logs as they pass through the ring assembly. The debarked logs exit the ring assembly and are carried downstream by outfeed press rolls and an outfeed conveyor.

Figure 2:
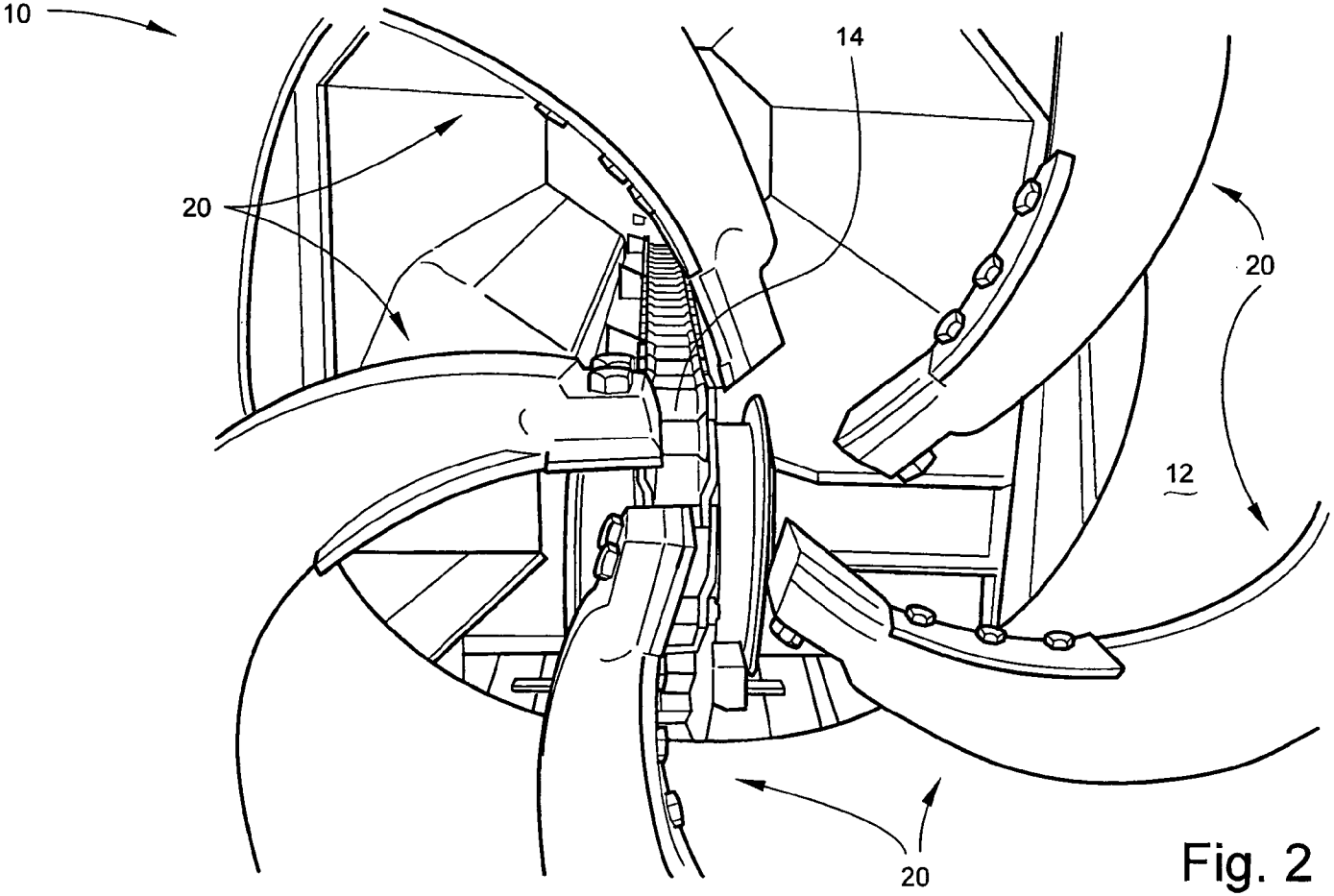
FIG. 2 is a partial perspective view of the debarking blades of a mechanical ring debarker according to one embodiment of the invention.

A mechanical ring debarker 10 is more specifically shown in FIG. 2 and, looking into the ring assembly 12 from the upstream infeed position, includes an outfeed conveyor 14. The mechanical ring debarker except for the debarking blades, are conventional and therefore not further explained. The mechanical ring debarker 10 includes a plurality of debarking blades 20, each of which is mounted to a ring rotor, as shown in FIG. 1. Each of the blades 20 are identical, and the following description of a single blade 20 is representative of each of the plurality of blades 20.

Figure 3:
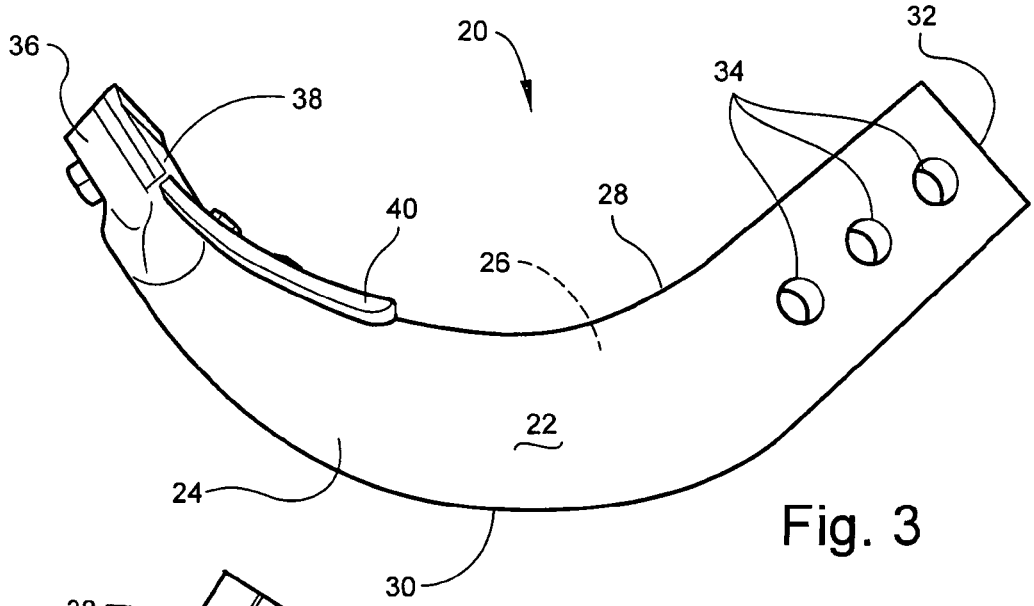
FIG. 3 is a perspective view of a debarker blade according to one embodiment of the invention.
Figure 4:
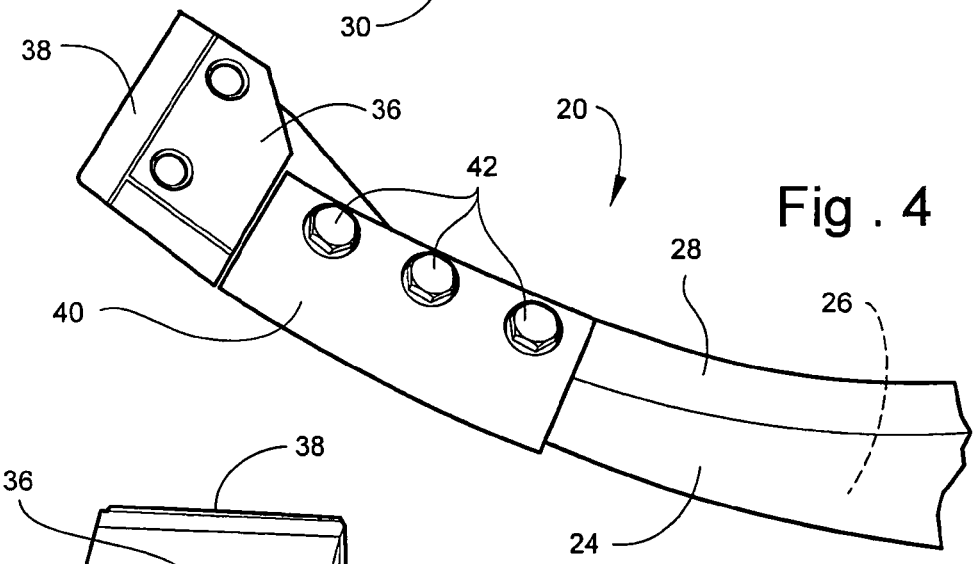
FIG. 4 is a side elevation of the debarker blade shown in FIG. 3.
Figure 5:
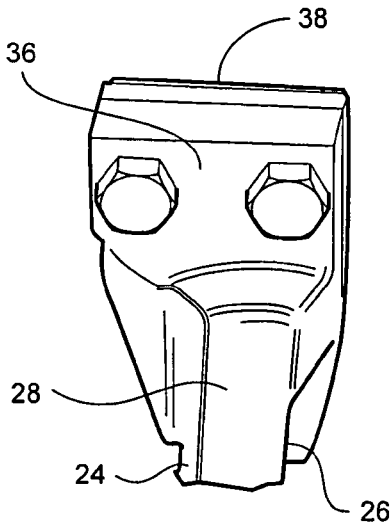
FIG. 5 is a fragmentary view of the top side of the debarker blade shown in FIG. 3.

Referring now to FIGS. 3-5, the debarking blade 20, according to this particular embodiment, includes a blade body 22 fabricated of plate steel having opposed, planar, parallel sides 24, 26 defining an arcuate shape having a concave inner edge 28 and a convex outer edge 30. An inner end 32 of the blade body 22 is provided with mounting holes 34 for mounting the blade 20 to the ring rotor. The free end of the blade 20 includes a cutting head 36 into which is bolted a hardened steel cutting tip 38 such as, for example, shown in applicant's U.S. Pat. No. 4,280,541.

A climbing edge insert 40, best shown in FIGS. 2 and 4, is mounted by bolts 42 to the concave inner edge 28 of the blade body 22. The climbing edge insert 40 has a curvature that corresponds to the concave inner edge 28 and extends outwardly over the inner side 26 of the blade body 22, as best shown in FIG. 4.

Figure 6:
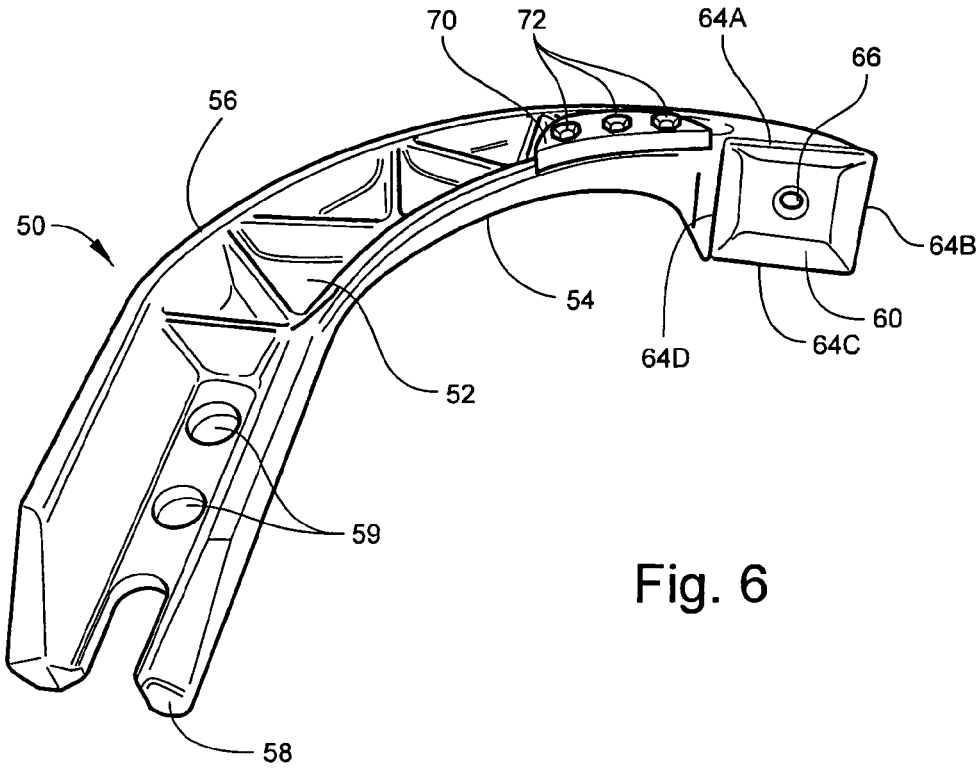
FIG. 6 is a perspective view of a debarker blade according to another embodiment of the invention.
Figure 7:
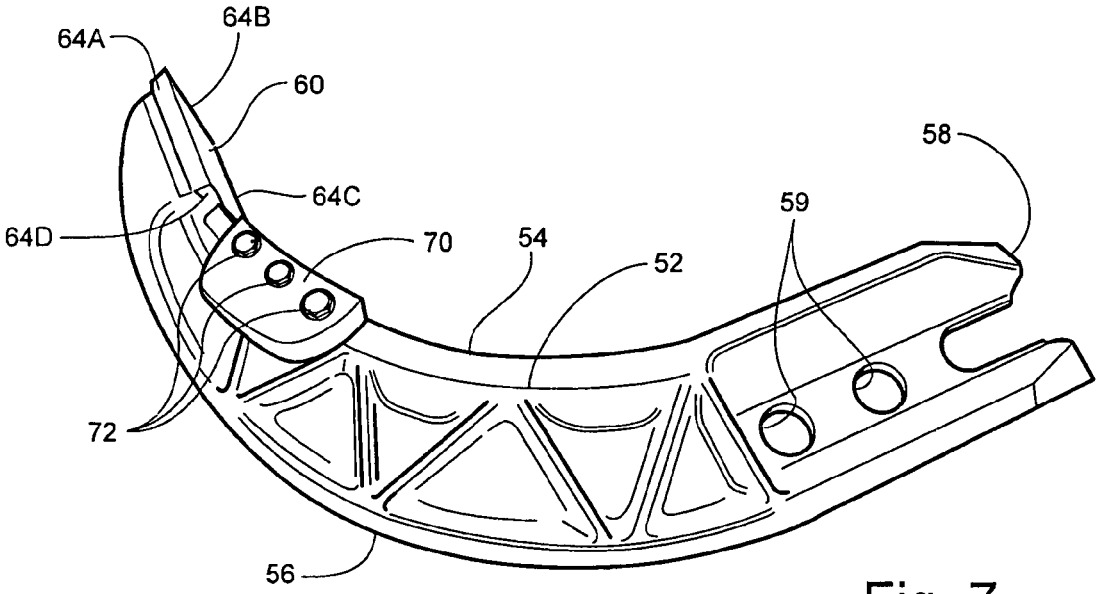
FIG. 7 is a perspective view from another angle of the embodiment shown in FIG. 6.

Referring now to FIGS. 6 and 7, the debarking blade 50 includes a cast steel blade body 52 defining a generally arcuate shape having a concave inner edge 54 and a convex outer edge 56. An inner end 58 of the blade body 52 is provided with mounting holes 59 for mounting the blade 50 to the ring rotor. The free end of the blade 50 includes a cutting head 60 into which is bolted a hardened steel cutting tip 62. The cutting head 60 is square and is designed with 4 cutting edges 64A-D. As a particular one of the cutting edges 64A-D is worn away, a fresh edge can be moved into the cutting position occupied by edge 64A in the drawings, by loosening the bolt 66 and rotating the cutting tip 62 to position the desired edge in the cutting position.

A climbing edge insert 70 is mounted by bolts 72 to one side of the blade body 52 at the concave inner edge 54. The climbing edge insert 70 has a curvature that corresponds to the concave inner edge and extends outwardly over the inner side 54 of the blade body 52. This form of attachment is referred to in the relevant industry as being from the side of the blade 50.

As with the blade 20, the blade 20 can be repaired or furnished with a new insert 70 simply, easily and at the log-processing site, as opposed to sending the blades back to a rebuild facility. Moreover, the ability to attach a replaceable insert 70 permits a much wider variation in design and insert orientation over and above prior art, built-up climbing edges.

An improved log debarking blade is described above. Various details of the invention may be changed without departing from the scope of the invention. Furthermore, the foregoing description of the preferred embodiment of the invention and best mode for practicing the invention are provided for the purpose of illustration only and not for the purpose of limitation, the invention being defined by the claims.

I claim:

1. A debarking blade for a debarking machine of the type having a rotatable ring rotor through which logs are longitudinally fed during a debarking operation, and comprising:

(a) an elongate blade body having an attachment end, an opposed free end, opposing sides, an arcuate concave inner edge extending between the opposing ends and facing generally inwardly toward the rotational axis of the ring rotor, and a generally planar mounting surface defined along one of the opposing sides along the inner edge of the blade body and facing a feed direction of the machine;

(b) a detachable cutting tip having a cutting edge thereon releasably mounted on the free end of the blade body for engaging and debarking a log; and (c) a detachable climbing edge insert releasably mounted on the planar mounting surface such that the insert extends outwardly from the mounting surface beyond the side of the blade body toward the feed direction and a climbing edge of the insert extends outwardly over the inner edge of the blade body toward the rotational axis, the climbing edge having a substantially sharp edge for engagement by successive logs being fed into the debarking machine for deflecting the debarking blade out of the path of the logs during rotation of the ring rotor to protect the blade from direct impact by the leading end of the log and to properly position the cutting tip for debarking the log, wherein the insert defines fastener receiving holes therethrough that align with holes defined through the mounting surface that are axially parallel with the feed direction, and wherein the climbing edge insert is free from attachment with the inner edge of the blade body.

2. A debarking blade according to claim 1, wherein the detachable climbing edge insert is mounted on the blade body by a plurality of bolts positioned through the respective aligned holes in the climbing edge insert and through the planar mounting surface of the blade body.

3. A debarking blade according to claim 1, wherein the climbing edge insert is mounted on the inner edge surface between the sides of the blade body.

4. A debarking blade according to claim 1, wherein the climbing edge insert and the cutting tip are mounted on the blade body in closely spaced-apart relation to each other.

5. A debarking blade according to claim 1, wherein the climbing edge insert has a curvature corresponding to the curvature of the arcuate shape of the blade body at the point of attachment of the climbing edge insert to the blade body.

6. A debarking blade according to claim 1, and including an enlarged cutting head fixed to the free end of the blade body and having a major widthwise dimension perpendicular to the opposed, planar sides of the blade body, the cutting tip being detachably mounted to the cutting head and projecting outwardly from the major widthwise dimension of the cutting head.

7. A debarking blade for a debarking machine of the type having a rotatable ring rotor through which logs are longitudinally fed during a debarking operation, and comprising:

(a) an elongate arcuate body having opposing free and attachment ends, an arcuate concave inner surface extending therebetween and adapted to face generally facing inwardly toward the rotational axis of the ring rotor, and opposing sides, one of the opposing sides defining a mounting surface extending along the inner surface and facing a feed direction of the machine;

(b) a detachable cutting tip having a cutting edge thereon releasably mounted on the free end of the blade body for engaging and debarking a log; and (c) a detachable climbing edge insert releasably mounted on the mounting surface of the blade body between the attachment end and the free end, the insert defining fastener receiving holes therethrough that align with holes defined through the mounting surface that are axially parallel with the feed direction, the climbing edge portion having a substantially sharp edge defining a log engaging climbing edge for engagement by successive logs being fed into the debarking machine for deflecting the debarking blade out of the path of the logs during rotation of the ring rotor to protect the blade from direct impact by the leading end of the log and to properly position the cutting tip for debarking the log, the climbing edge insert projecting rearwardly from blade body having one end terminating closely adjacent to the cutting tip and defining a terminal corner portion projecting rearwardly of the cutting tip for protectively shielding the cutting tip from impact by the leading ends of successive logs being fed through the ring rotor and preventing the leading ends of the logs from engaging the cutting tip, the climbing edge insert further extending outwardly over the inner edge of the blade body toward the rotational axis, and wherein the climbing edge insert is free from attachment with the inner edge of the blade body.

* * * * *

UNITED STATES PATENT AND TRADEMARK OFFICE

CERTIFICATE OF CORRECTION

PATENT NO. : 7,806,153 B2
APPLICATION NO. : 12/014572
DATED : October 5, 2010
INVENTOR(S) : James L. Reimler It is certified that error appears in the above-identified patent and that said Letters Patent is hereby corrected as shown below:

Column 6, line 9, delete "adapted to face generally".

Signed and Sealed this

Twenty-third Day of November, 2010

David J. Kappos

David J. Kappos
*Director of the United States Patent and Trademark Office*